US006879792B2

(12) United States Patent
Carter et al.

(10) Patent No.: US 6,879,792 B2
(45) Date of Patent: Apr. 12, 2005

(54) TWO PART CARTRIDGES WITH FORCE BIASING BY PRINTER

(75) Inventors: Philip Scot Carter, Lexington, KY (US); Julia L. Fain, Lexington, KY (US); Mark Duane Foster, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/736,355

(22) Filed: Dec. 15, 2003

(65) Prior Publication Data

US 2004/0126133 A1 Jul. 1, 2004

Related U.S. Application Data

(63) Continuation of application No. 10/195,270, filed on Jul. 15, 2002, now Pat. No. 6,678,489.

(51) Int. Cl.[7] ..... G03G 21/18
(52) U.S. Cl. ..... 399/113; 399/114
(58) Field of Search ..... 399/26, 107, 111–114, 399/116, 117, 155

(56) References Cited

U.S. PATENT DOCUMENTS 5,028,966 A 7/1991 Kozuka et al.
5,204,713 A 4/1993 Yamamura
5,266,998 A 11/1993 Lee
5,369,479 A 11/1994 Tsuyuki
5,708,912 A 1/1998 Lee
6,041,203 A * 3/2000 Suzuki et al. ..... 399/113
6,070,029 A 5/2000 Nishiuwatoko et al.
6,101,350 A 8/2000 Suzuki et al.
6,118,961 A 9/2000 Nomura et al.
6,163,660 A 12/2000 Maeshima et al.
6,163,666 A * 12/2000 Hosokawa et al. ..... 399/117
6,173,140 B1 * 1/2001 Suzuki et al. ..... 399/113
6,678,489 B1 * 1/2004 Carter et al. ..... 399/113

* cited by examiner

*Primary Examiner*—Arthur T. Grimley
*Assistant Examiner*—Ryan Gleitz
(74) *Attorney, Agent, or Firm*—Joseph Arrombide; Arthur I. Navarro

(57) ABSTRACT

A two part cartridge having a photoconductor part (1) and a toner part (5) having no force biasing element on either part. The two parts fit together so that a developer roller (7) in the toner part contacts a photoconductor drum (3) in the other part. When the two parts are installed in a printer the cover (50), when closed, brings a spring (62) into contact with one side of the toner part while the frame (F) of the printer blocks movement away from the cover. An advantage of the two part cartridge is that the toner part can be replaced without replacing the photoconductor part. Members on the cartridge for force biasing are avoided and the need for training or skill to latch the parts together is avoided.

11 Claims, 9 Drawing Sheets

TWO PART CARTRIDGES WITH FORCE BIASING BY PRINTER

RELATED APPLICATION

This application is a continuation of U.S. application Ser. No. 10/195,270, filed Jul. 15, 2002 now U.S. Pat. No. 6,678,489, and titled Two Part Cartridges with Force Biasing by Printer.

TECHNICAL FIELD

This invention relates to electrophotographic imaging and, more particularly, relates to separate replaceable cartridges for toner and photoconductor, which are pressed together for good operation when installed in the imaging device.

BACKGROUND OF THE INVENTION

Electrophotographic toner cartridges are often joined in two sections pivoted to one another so that a developer roller can be pressed against a photoconductor drum with controlled pressure. The controlled pressure is provided by permanently installed springs stretching between the two sections. The two sections are not normally separated, so such cartridges can be said to be one part cartridges.

Such one part cartridges have the advantage of having the spring force installed at the factory manufacturing the cartridge and having a relatively short duration during which the springs need provide the correct pressure, since the entire cartridge is refurbished (or discarded) after use of the original cartridge. Such one-piece cartridges have the disadvantage that the springs must be included on each cartridge. Also, for such one piece cartridges, replacement of the toner with a new section having the toner is not practical since the sections are not readily separated.

Two part cartridges are known in which a part having the toner is readily separated from a part having the photoconductor drum, since they are not pivoted to one another. To install such two part cartridges for imaging, they are manually brought together by the operator, and then the operator activates a latching mechanism, such as a resilient latch or a lever of some kind, to force the two parts together with the appropriate pressure for imaging.

A disadvantage of such known two part cartridges is that the forcing mechanism must be on one or both of the two parts and therefore adds to supplies costs, as both of the two parts are typically replaceable as they are worn (in the case of the photoconductor and other physical parts) or expended (in the case of the toner). Another disadvantage is that operator involvement requires training or some skill, and requires an overall design which permits the operator to reach the latching mechanism and activate it or deactivate it. A further disadvantage is that the force biasing elements require some space in the body of the imaging devide.

DISCLOSURE OF THE INVENTION

This invention provides for two part cartridges which have no mechanism to latch the cartridges together. Biasing force during use is provided from the cover of the imaging device when closed. The two parts need only have conforming external configurations so that they fit together, and require no space in the middle of the printer for a force biasing element. No operator involvement in forcing the two parts together is required except for inserting the cartridges in the imaging device and closing the cover of the imaging device. Although the biasing by the cover may be by a spring or springs more costly than springs or other forcing mechanism which might be on the parts, over the life of the imaging device the overall costs typically will be less.

BRIEF DESCRIPTION OF THE DRAWINGS

The details of this invention will be described in connection with the accompanying drawings, in which.

DESCRIPTION OF THE PREFERRED EMBODIMENTS

Figure 1:
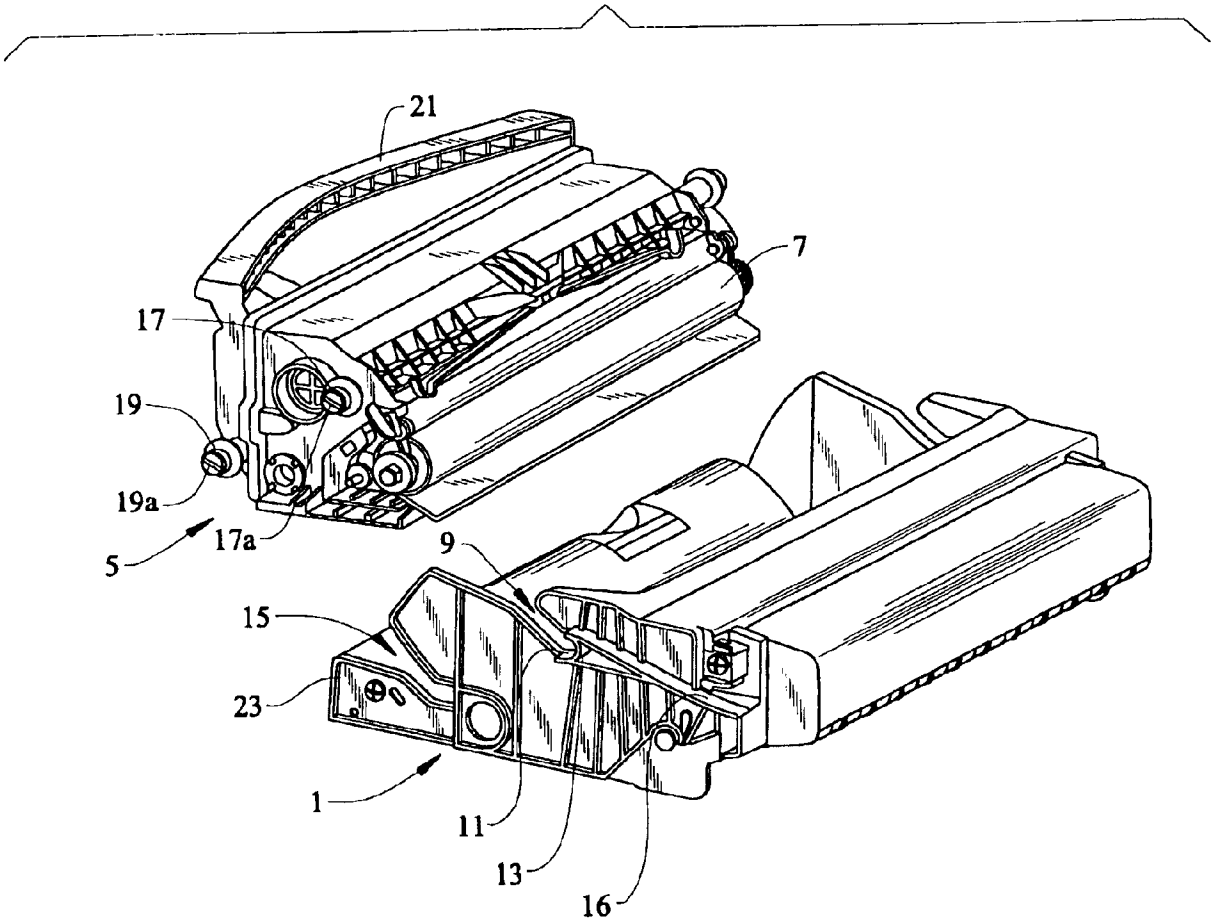
FIG. 1 is a perspective view from the right of the two parts of the cartridge separated.

Referring to FIG. 1, a replaceable cartridge part 1 containing a photoconductive drum 3 (shown in FIG. 2) is shown separated from a replaceable cartridge part 5 containing a developer roller 7 and toner (not shown). The right side of part 1 has an upper guide channel 9 ending in a flat section 11 having a rear wall 13. The right side of part 1 also has a lower guide channel 15. Planar member 16 is a guide for installation in a printer.

Figure 2:
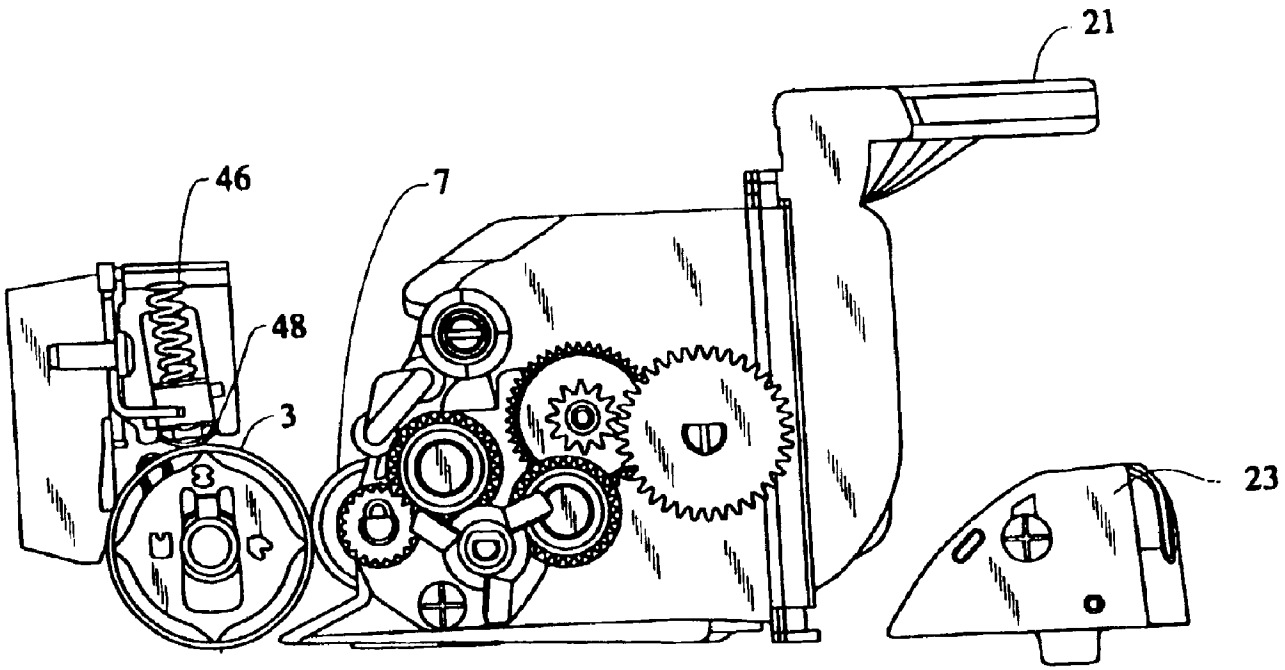
FIG. 2 is a side view from the left with covers removed showing selected parts of the two parts of the cartridge in contact when being forced together by the cover of the printer.
Figure 3:
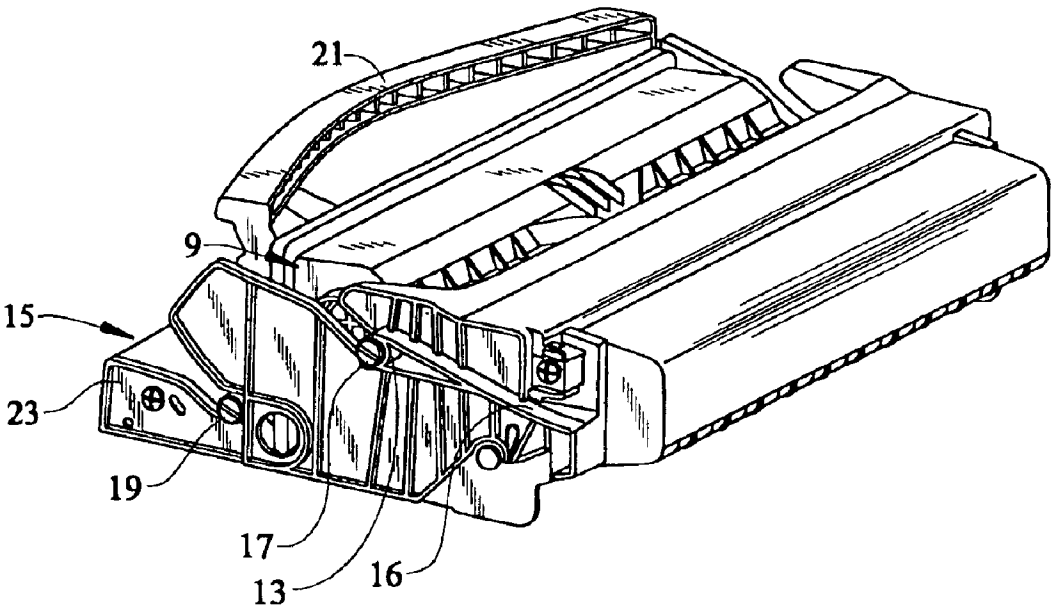
FIG. 3 is a side view from the right of the two parts of the cartridge forced together.

The right side of part 5 has an upper guide stud 17 and a lower guide stud 19. FIG. 3 shows the two parts 1 and 5 forced together in accordance with this invention. Guide stud 17 fits in channel 9 but does not reach wall 13. Similarly, guide stud 19 fits in channel 15. Channels 9 and 15 direct the guide studs 17 and 19 respectively to bring developer roller 7 in contact with photoconductor drum 3 (FIG. 2).

Part 5 has an upper handle 21, which can be readily grasped by an operator to pull part 5 away from part 1. Part 1 has a lower handle 23 which extends past part 5 when the two are combined (FIG. 2). Handle 21 and handle 23 can be grasped and pulled by an operator to pull out part 1 and part 5.

Since part 5 contains toner used for imaging, part 5 will be extracted and replaced with a replacement part 5 having toner more frequently than part 1 will be replaced. Part 1 will be extracted and replaced with a replacement part 1 when the photoconductor becomes deteriorated or when excess toner fills the compartment in part 1 for toner cleaned from the photoconductor 3 (such cleaning is standard).

Figure 4:
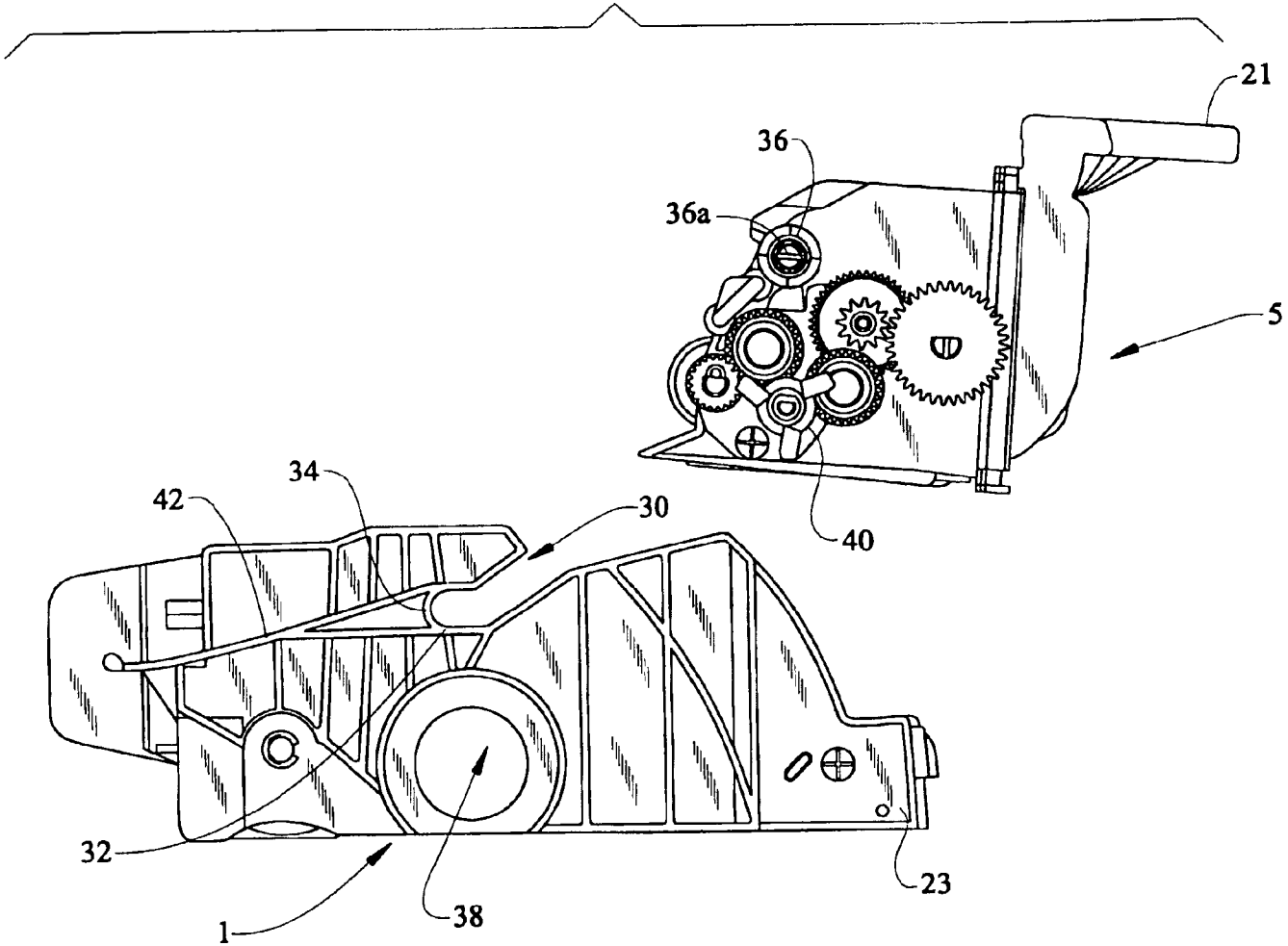
FIG. 4 is a side view from the left of the two parts of the cartridge separated.
Figure 5:
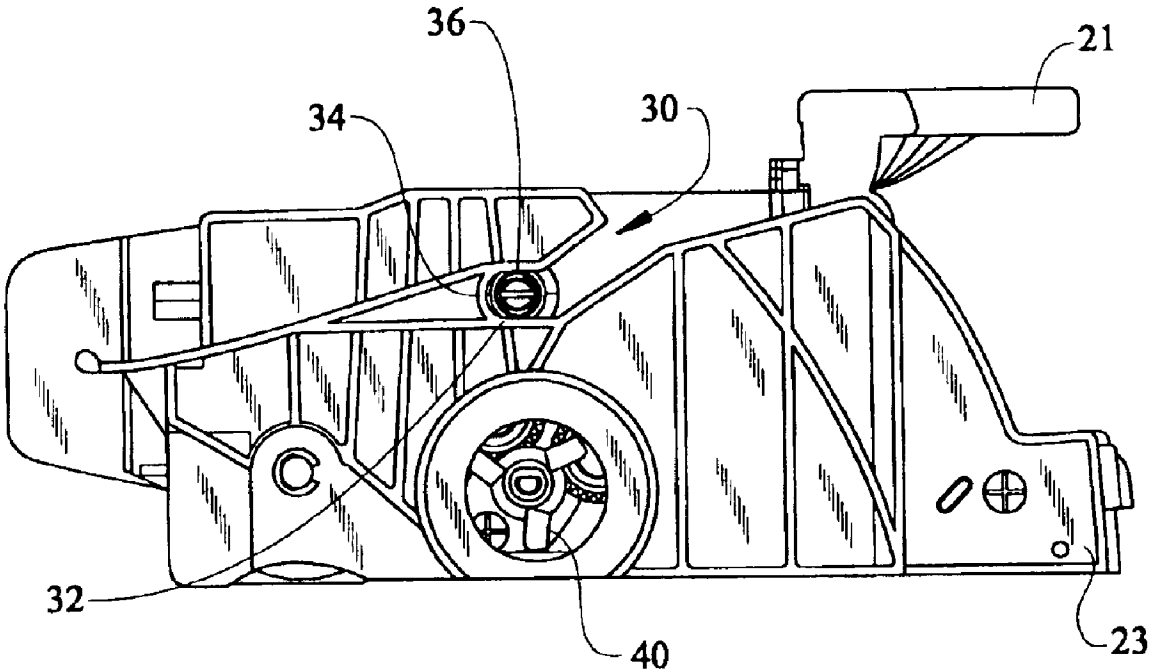
FIG. 5 is a side view from the left of the two parts of the cartridge forced together.

Referring to FIG. 4, the two parts 1 and 5 are shown from the left side separated. Part 1 has a guide channel 30 ending in a flat section 32 having a rear wall 34. Part 5 has a guide stud 36. The cover of part 1 has an opening 38 to provide external access to driven coupling 40 when part 5 is pressed against part 1 (FIG. 5). Planar member 42 is a guide for installation in a printer, as is standard.

The action of the drive coupling and the gears shown will not be described in detail as they are essentially standard for imaging by driving known parts, not shown, including a toner adder roller and a toner mixing paddle, as well photoconductor drum 3 and the developer roller 7. Similarly, with reference to FIG. 2, spring 46 biasing a change roller 48 against photoconductor 3 is standard and will not be further discussed.

FIG. 5 shows parts 1 and 5 from the left forced together in accordance with this invention. Guide stud 36 fits in channel 30 but does not reach wall 34. Channel 30 directs stud 36 to bring developer roller 7 in contact with photoconductor drum 3 (FIG. 2). Driven coupler 40 is located in opening 38 (FIG. 4) for access by a printer drive coupler (not shown).

Guide studs 17, 19 and 36 are external caps of DELRIN 500 polyacetal, a hard plastic, mounted on shafts integral with the body of part 5. The body of part 5 is made of polystyrene. Openings 17*a*, 19*a* (FIG. 1) and 36*a*(FIG. 4) permit flexing of the shafts. The DELRIN polyacetal caps have a circumferential groove which meshes with small, radial tongues (not shown) extending into the grooves of the caps to thereby form studs 17, 19 and 38. The caps are free to rotate, but they may simply slide without loss of important function with respect to this invention. Alternative materials and construction of studs 17, 19 and 36 could be readily employed.

Figure 6:
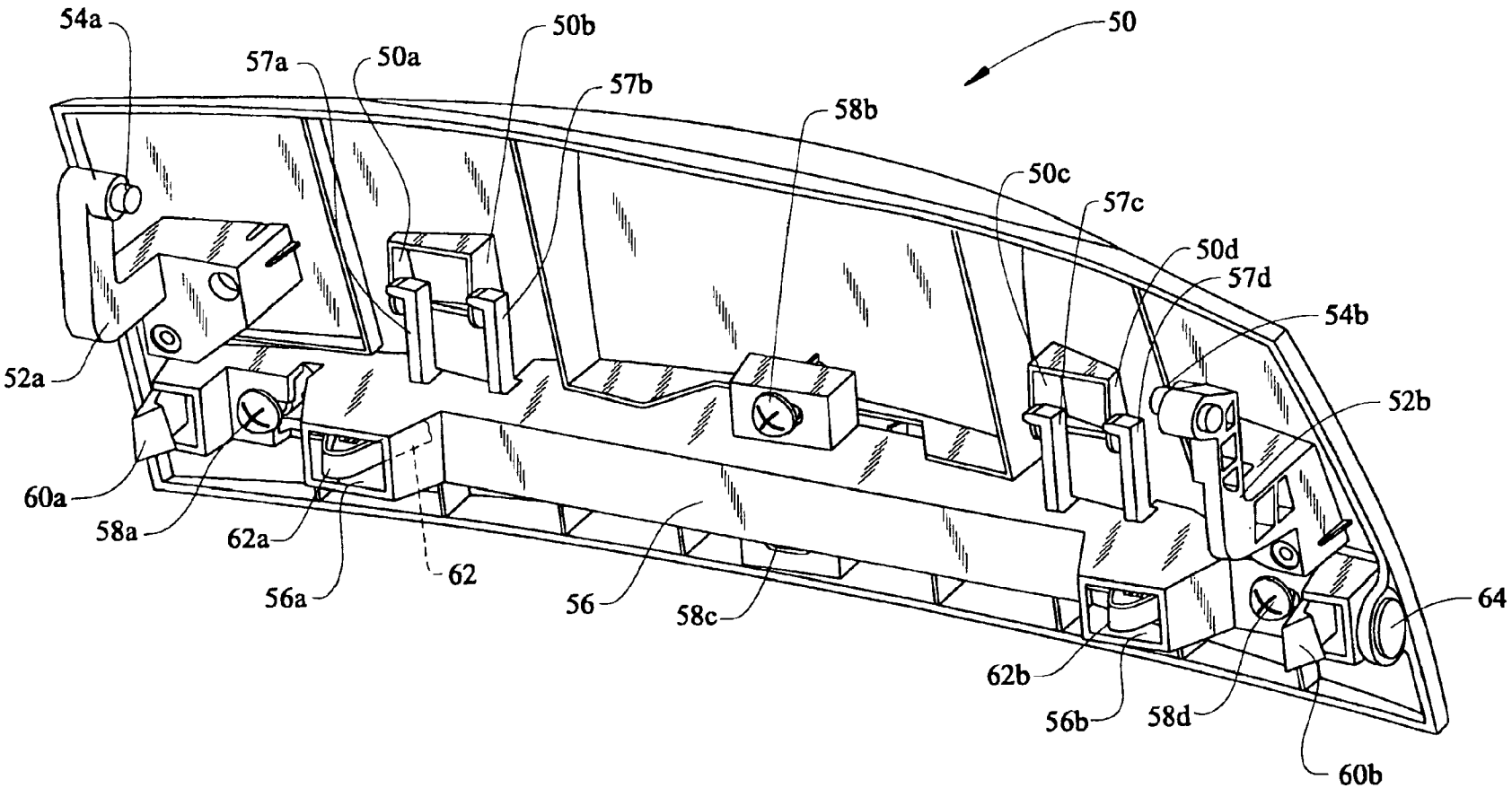
FIG. 6 is a perspective view from the left showing the inside of the cover of the printer.

Referring to FIG. 6, the inside of printer cover 50 is shown, which may be made of a standard, strong plastic. Mounted on opposite sides of cover 50 are pivot arms 52*a* and 52*b*, having near their ends pivot studs 54*a* and 54*b*. Pivot studs 54*a* and 54*b* enter frame F (FIG. 8) of the printer (only frame of printer illustrated in this description) to define fixed pivot points of cover 50 relative to the frame F.

Mounted on the inside of cover 50 is one-piece housing 56, mounted to cover 50 by four screws, 58*a*–58*d*. Housing 56 has latching members 60*a* and 60*b* on opposite sides of cover 50. Primarily significant to this invention, housing 50 confines a leaf spring 62, having opposed bent ends 62*a* and 62*b* which extend past housing 56 at openings 56*a* and 56*b* on opposite sides of cover 50.

Housing 56 has integral, upward extending arms 57*a*–57*d*, which contact cover extensions 50*a*–50*d*. Screws 58*a*–58*d* are located in lateral, oval slots in housing 56. Integral with housing 56 on the left is a flat, pressing surface or "button" 64. When cover 50 is closed, latching members 60*a* and 60*b* are pushed leftward by arms 57*a*–57*d* acting on extensions 50*a*–50*d*. An operator pushing on button 64 overcomes this force and frees latches 60*a* and 60*b* to allow cover 50 to open.

Figure 7:
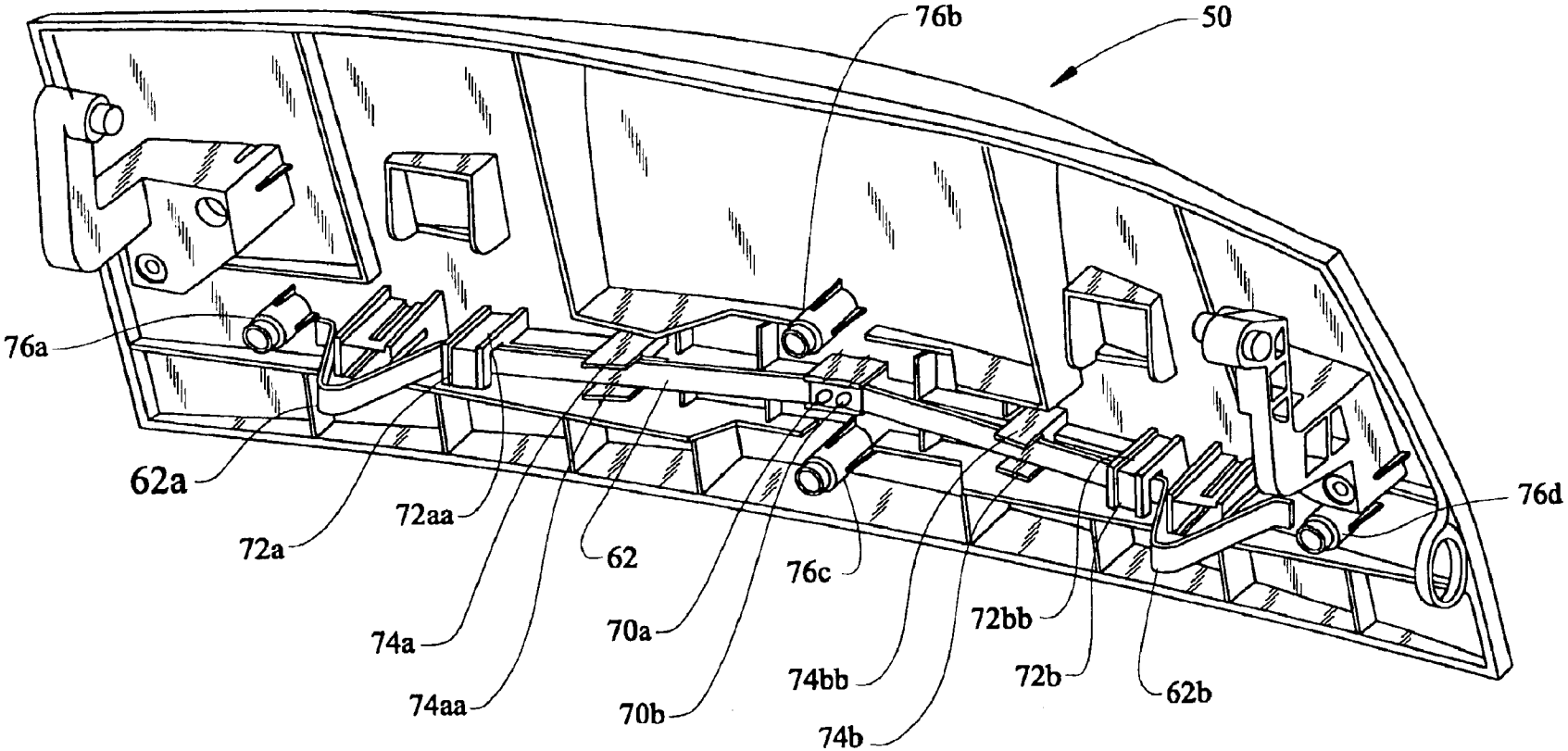
FIG. 7 is a perspective view of the cover like the view of FIG. 6 with a housing deleted to fully show the spring mounting.

FIG. 7 is the same view as FIG. 6 with housing 56 and its integral parts deleted so as to better show spring 62 and its mounting. In this embodiment, spring 62 is a single leaf spring held against cover 50 by two screws 70*a*, 70*b* located at the center of spring 62. Spring 62 is held against undue movement away from cover 50 by spaced ledge members 72*a*, 72*b* on cover 50. Spring 62 is confined from undue movement laterally by the extensions 72*aa* and 72*bb* holding ledge members 72*a* and 72*b* and by upper and lower spaced ledges 74*a*, 74*aa* and 74*b* and 74*bb*. Mounting posts 76*a*–76*d* receive screws 58*a*–58*d* (FIG. 6).

Figure 8:
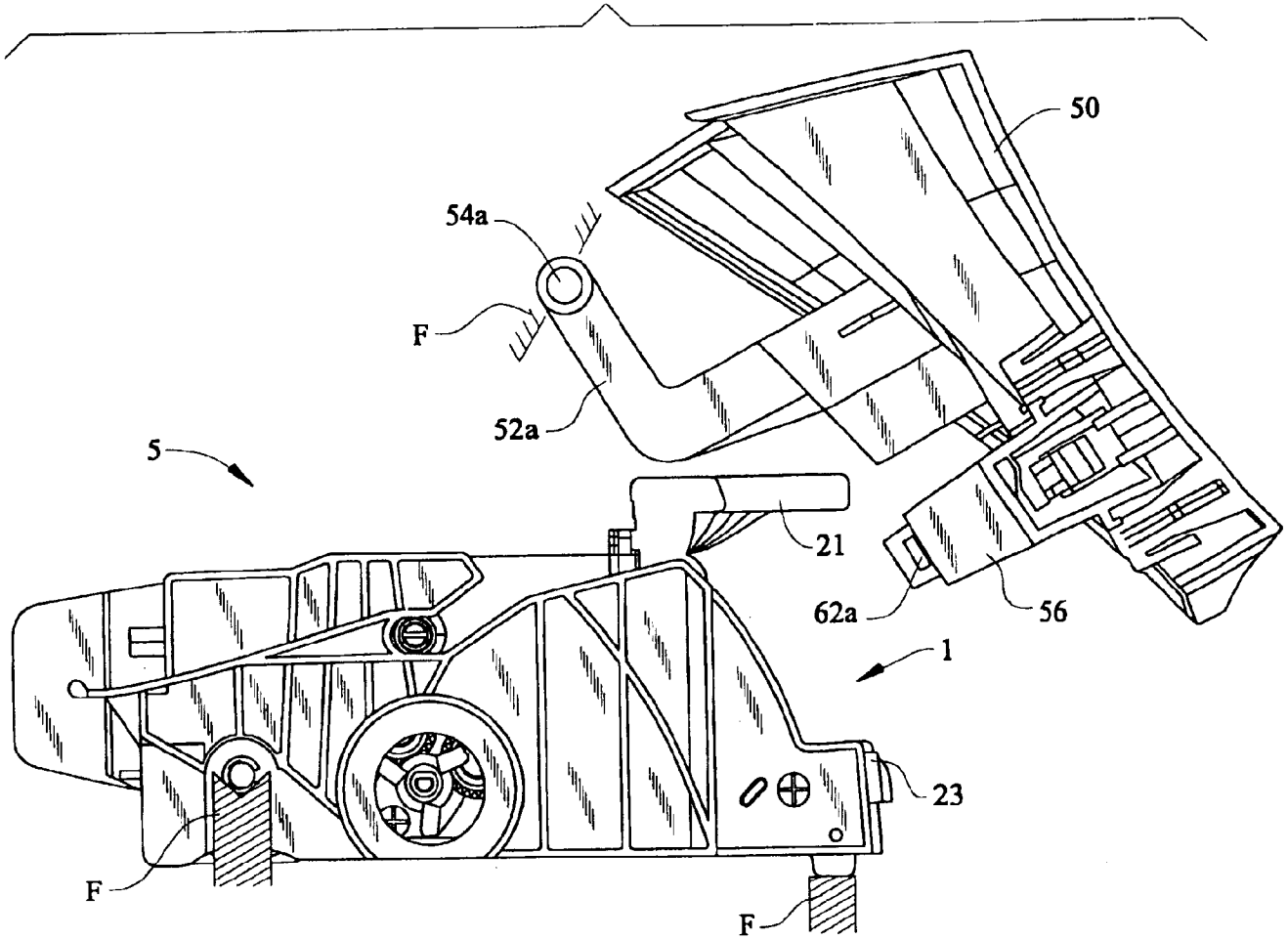
FIG. 8 is a side view from the left sectioned in the middle of the cover showing the cover open and the cartridge parts installed in the printer.

FIG. 8 shows cover 50 open and the full cartridge of parts 1 and 5 in its installed position on the printer, illustrated as frame elements F. The installed parts are held against further movement away from cover 50 by being blocked by frame F.

Figure 9:
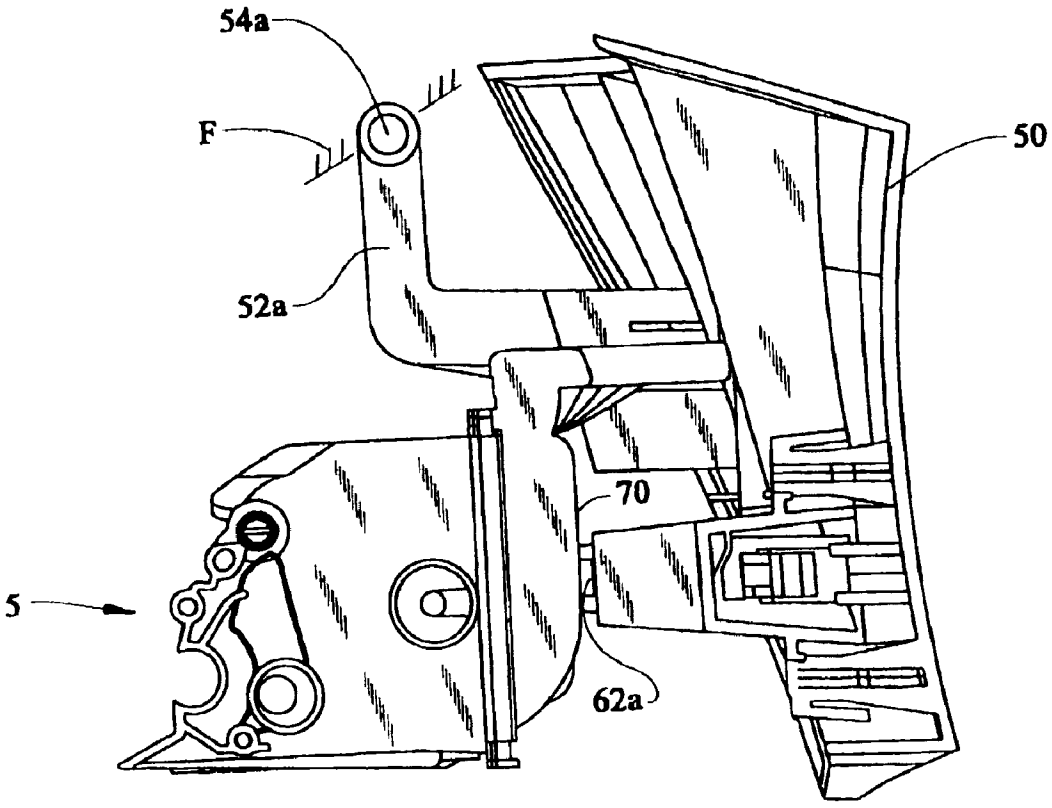
FIG. 9 is a side view as in FIG. 8 showing part 5 with the cover pivoted to its final position in which it is applying a force by contacting on the toner part of the cartridge.

FIG. 9 omits cartridge part 1 to better illustrate cartridge part 5. Part 5 is also in the installed position as shown in FIG. 8. In this position part 1 has a substantially vertical front wall 70. Upon closing of cover 50, the ends 62*a* and 62*b* encounter front wall 70 of cartridge part 5 and press it against part 1. As discussed with respect to FIG. 8, the installed cartridge parts 1 and 5 are held against movement away from door 50 by frame members of the printer. Latch members 60*a* and 60*b* flex past ledges (not shown) in the frame F and then latch over the ledges,

VARIATIONS AND ALTERNATIVES

Although spaced spring contacts as in the foregoing embodiment tend to minimize variations between printers from differences within accepted tolerance, clearly a single leaf spring mounted in the center is an alternative. Of course, two spaced coil springs is an alternative. Other members can provide resilience, such a urethane rubber pads. Instead of spaced contacts, a wide, resilient pad could provide the force biasing. In sum, this invention is not deemed limited by the details of the biasing member operating from the cover. The cover could provide a linkage to move a separated biasing member with movement of the cover, although this normally would be more expensive than simply mounting the biasing member on the cover.

A modification of the foregoing under consideration is to replace spring 62 by two, separate leaf springs, each originating near the middle of cover 50 and terminating as shown in the foregoing.

Although the cover in the foregoing embodiment opens from the bottom, a clear alternative would be to hinge the cover on the bottom so that it opens from the top.

Other variations and alternatives will be readily apparent or can be anticipated.

What is claimed is:

1. A two part imaging cartridge in which one part is in contact with the other part by at least two guide studs on one of said two parts entering at least two guide channels on the other of said two parts, one of said two parts containing a developer member and the other of said two parts containing a photoconductor, said guide channel being directed to bring said developer member in contact with said photoconductor and having an open end for said entry of said guide stud;

said two parts having no force biasing member on either part for force biasing said photoconductor against said developer member, force biasing for imaging being dependent upon external force being applied to said two parts;

said part containing a developer member having at least one of said two guide studs.

2. The two part imaging cartridge of claim 1 wherein said two guide studs are on one side of one of said two parts.

3. The two part imaging cartridge of claim 2 wherein said two guide channels are one side of the other of said two parts opposite said two guide studs.

4. The two part imaging cartridge of claim 1 wherein said two guide studs comprise an upper guide stud and a lower guide stud on one side of one of said two parts.

5. The two part imaging cartridge of claim 4 wherein said two guide channels comprise an upper guide channel and a lower guide channel on one side of the other of said two parts opposite said two guide studs.

6. The two part imaging cartridge of claim 1 further comprising a third guide stud on one of said two parts entering a third guide channel on the other of said two parts.

7. The two part imaging cartridge of claim 6 wherein two of said guide studs are one side of one of said two parts and enter guide channels on one side of the other of said two parts.

8. The two part imaging cartridge of claim 7 wherein a third of said guide studs are on a second side of one of said two parts and enters a guide channel on a second side of the other of said two parts.

9. The two part imaging cartridge of claim 1 further comprising a first handle on one of said two parts.

10. The two part imaging cartridge of claim 9 further comprising a second handle on the other of said two parts.

11. A two part imaging cartridge in which one part is in contact with the other part by at least two guide studs on one of said two parts entering at least two guide channels on the other of said two parts, one of said two parts containing a developer member and the other of said two parts containing a photoconductor, said guide channels being directed to bring said developer member in contact with said photoconductor and having an open end for said entry of said guide studs;

said two parts having no force biasing member on either part for force biasing said photoconductor against said developer member, force biasing for imaging being dependent upon external force being applied to said two parts;

said part containing a photoconductor having at least one of said two guide channels.

* * * * *